US010368703B2

(12) United States Patent
Traub

(10) Patent No.: US 10,368,703 B2
(45) Date of Patent: Aug. 6, 2019

(54) TOILET PAPER HOLDING SYSTEM

(71) Applicant: Eric Traub, Savannah, GA (US)

(72) Inventor: Eric Traub, Savannah, GA (US)

( * ) Notice: Subject to any disclaimer, the term of this patent is extended or adjusted under 35 U.S.C. 154(b) by 324 days.

(21) Appl. No.: 15/352,735

(22) Filed: Nov. 16, 2016

(65) Prior Publication Data

US 2018/0132677 A1 May 17, 2018

(51) Int. Cl.
*A47K 10/38* (2006.01)

(52) U.S. Cl.
CPC ..... *A47K 10/38* (2013.01)

(58) Field of Classification Search
CPC ..... A47K 10/40; A47K 10/38
See application file for complete search history.

(56) References Cited

U.S. PATENT DOCUMENTS

| | | | | |
|---|---|---|---|---|
| 960,363 | A | 6/1910 | Marshall | |
| 1,224,378 | A * | 5/1917 | Hillyard | A47K 10/38 242/598.2 |
| 1,462,176 | A | 7/1923 | Hartmeyer | |
| 2,157,419 | A * | 5/1939 | Marchev | B41L 9/08 242/598.2 |
| 2,466,957 | A * | 4/1949 | Lewis | A47K 10/22 242/598.1 |
| 3,022,957 | A * | 2/1962 | Blunt | A47K 10/38 211/101 |
| 3,180,586 | A * | 4/1965 | Caravella | A47K 10/40 242/598.2 |
| D314,108 | S | 1/1991 | Chap | |
| 5,253,818 | A * | 10/1993 | Craddock | A47K 10/40 242/596.4 |
| 5,718,393 | A | 2/1998 | Serizawa | |
| 5,868,344 | A | 2/1999 | Melnick | |
| 6,199,791 | B1 | 3/2001 | Conran et al. | |
| 7,367,524 | B2 | 5/2008 | Burnett | |
| 7,762,493 | B2 * | 7/2010 | Berberet | A47K 10/405 242/598.2 |
| 8,282,034 | B1 | 10/2012 | Channel et al. | |
| 2002/0020780 | A1 | 2/2002 | Otsuji | |

FOREIGN PATENT DOCUMENTS

| | | |
|---|---|---|
| WO | WO9802373 | 1/1998 |

* cited by examiner

*Primary Examiner* — William A. Rivera

(57) ABSTRACT

A toilet paper holding system for holding a roll of toilet paper includes a pair of arms that are each coupled to a vertical support surface having the arms being spaced apart from each other. A holder is hingedly coupled between the pair of arms. The holder is selectively positioned in an open position to have a roll of toilet paper positioned thereon. The holder is selectively positioned in a closed position to retain the roll of toilet paper between the arms.

8 Claims, 4 Drawing Sheets

TOILET PAPER HOLDING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art including information disclosed under 37 CFR 1.97 and 1.98

The disclosure and prior art relates to holding devices and more particularly pertains to a new holding device for holding a roll of toilet paper.

BRIEF SUMMARY OF THE INVENTION

An embodiment of the disclosure meets the needs presented above by generally comprising a pair of arms that are each coupled to a vertical support surface having the arms being spaced apart from each other. A holder is hingedly coupled between the pair of arms. The holder is selectively positioned in an open position to have a roll of toilet paper positioned thereon. The holder is selectively positioned in a closed position to retain the roll of toilet paper between the arms.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
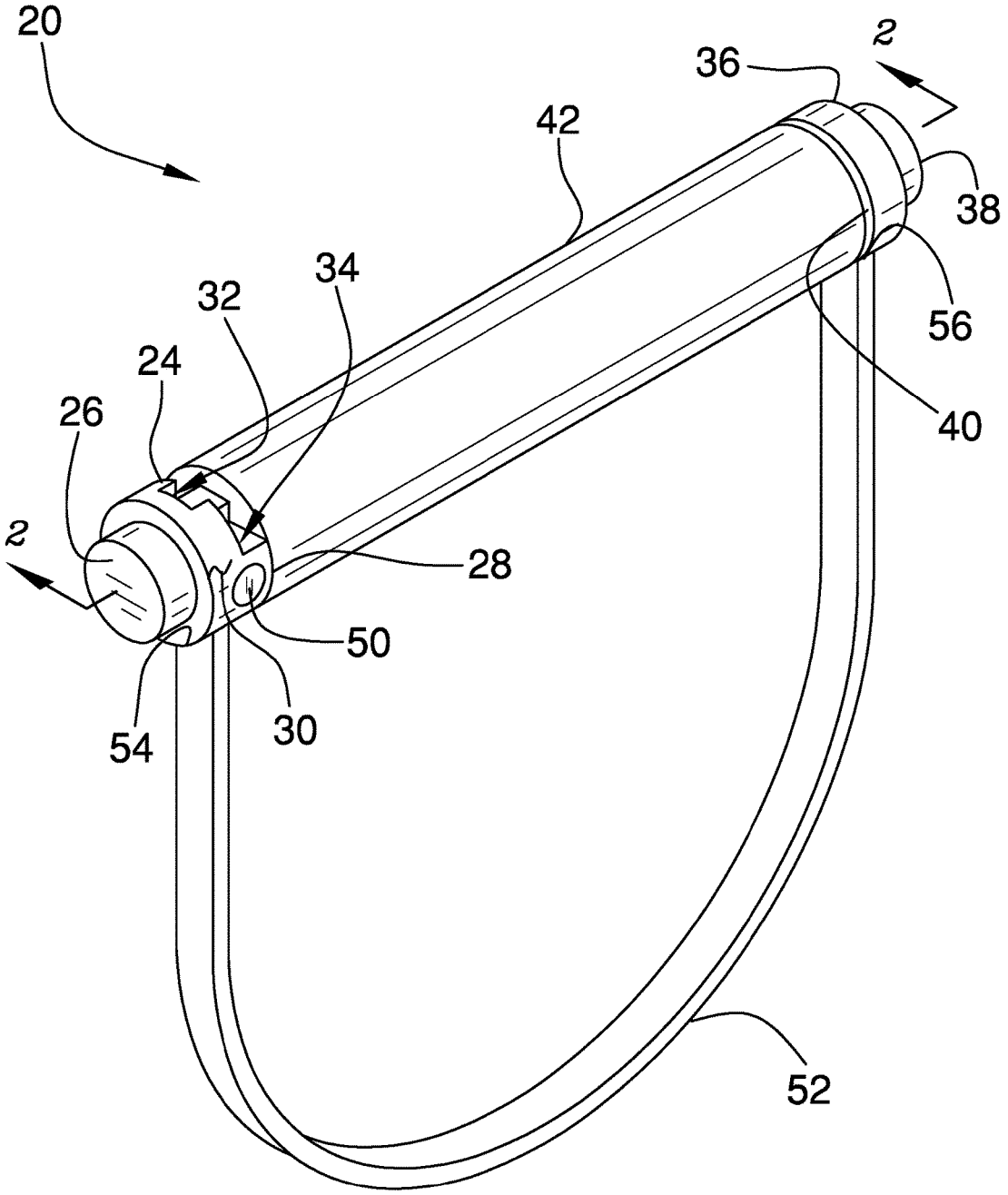
FIG. 1 is a perspective view of a holder of a toilet paper holding system according to an embodiment of the disclosure.
Figure 2:
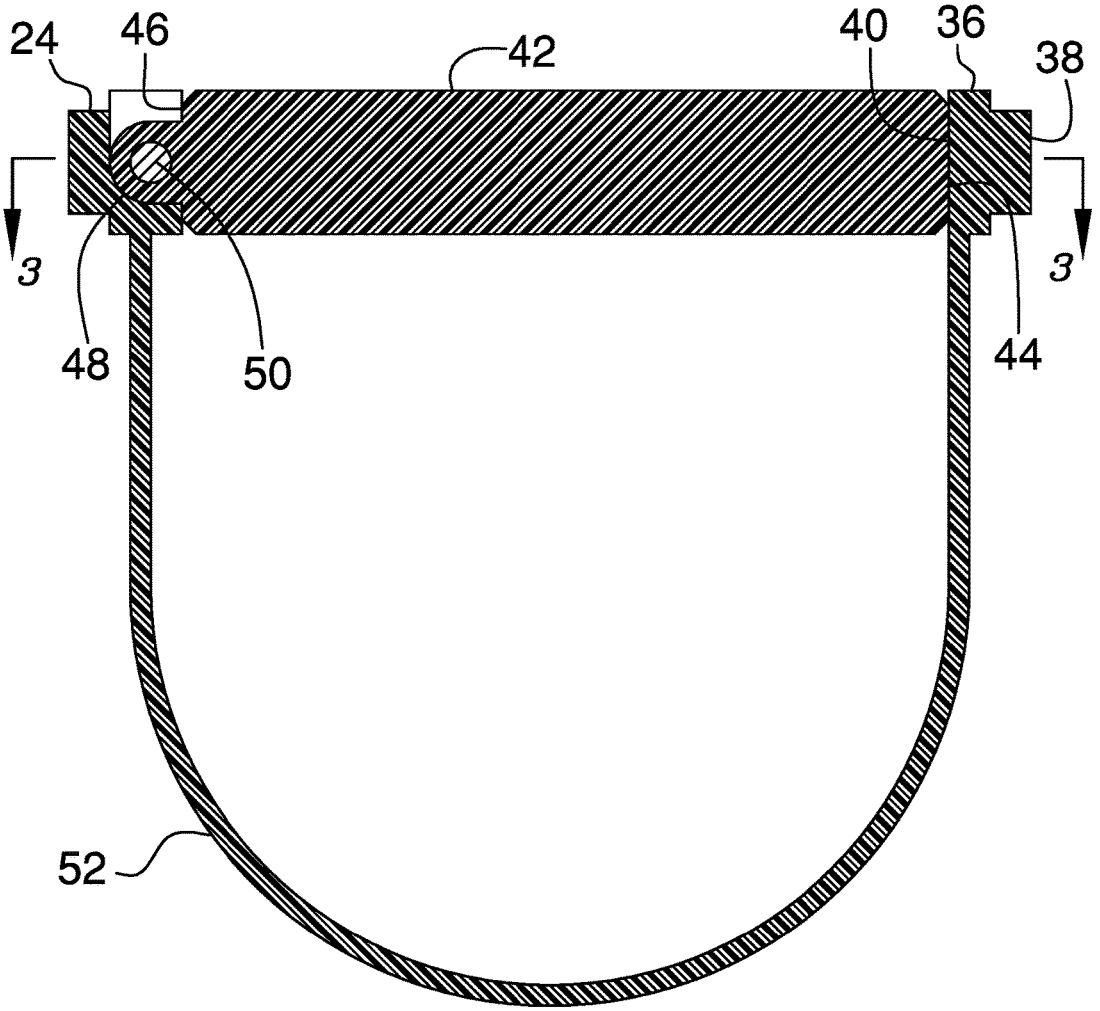
FIG. 2 is a cross sectional view taken along line 2-2 of FIG. 1 of an embodiment of the disclosure.
Figure 3:
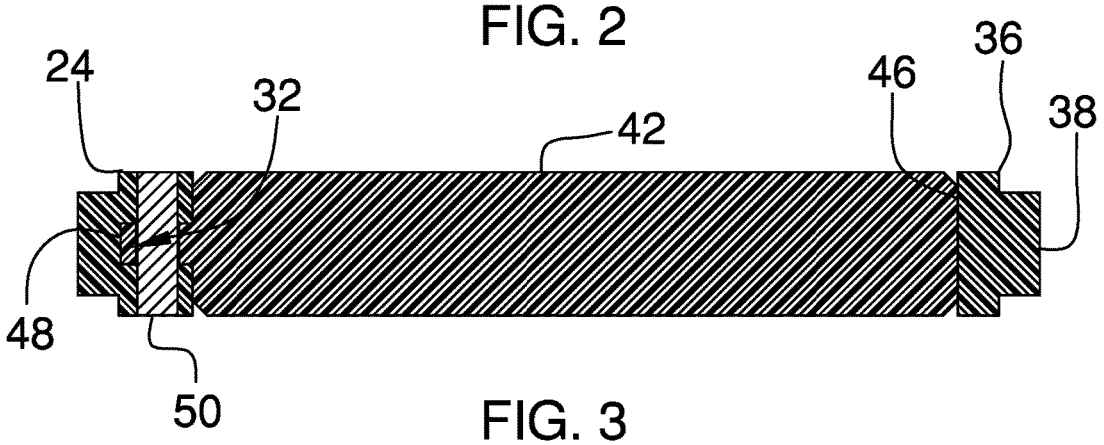
FIG. 3 is a cross sectional view taken along line 3-3 of FIG. 2 of an embodiment of the disclosure.
Figure 4:
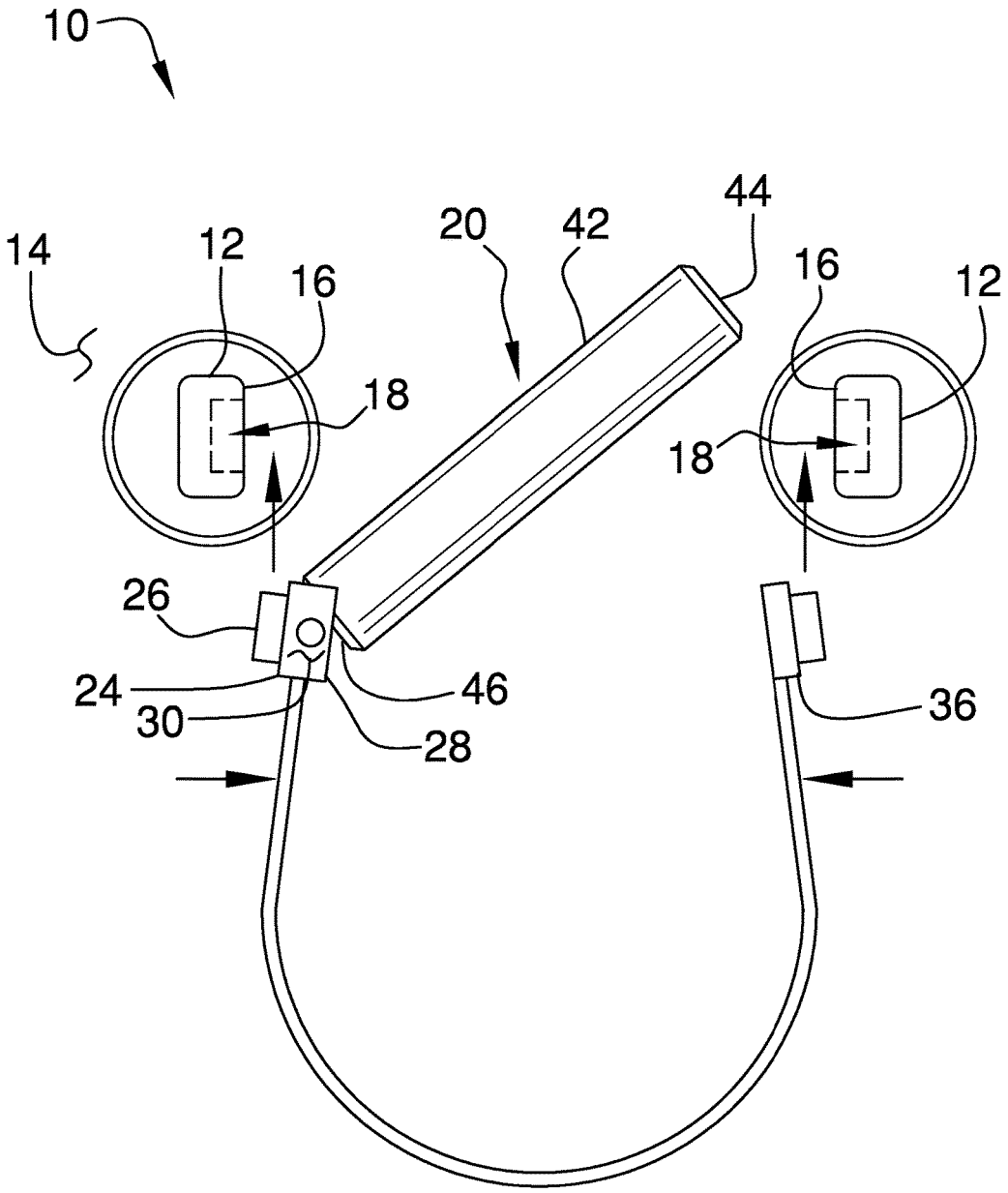
FIG. 4 is a front perspective view of an embodiment of the disclosure.
Figure 5:
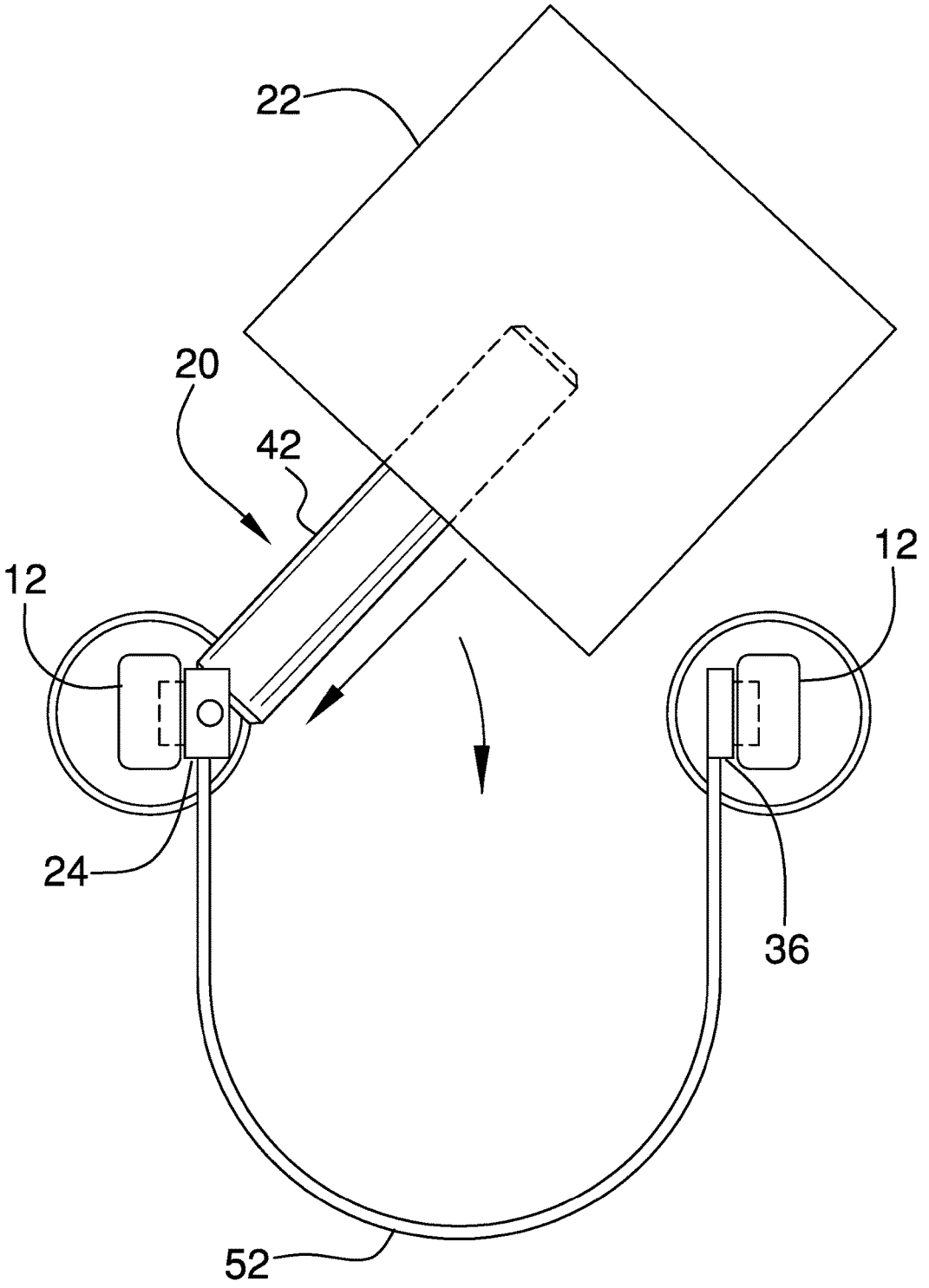
FIG. 5 is a perspective in-use view of an embodiment of the disclosure.

With reference now to the drawings, and in particular to FIGS. 1 through 5 thereof, a new holding device embodying the principles and concepts of an embodiment of the disclosure and generally designated by the reference numeral 10 will be described.

As best illustrated in FIGS. 1 through 5, the toilet paper holding system 10 generally comprises a pair of arms 12. Each of the arms 12 is coupled to a vertical support surface 14 having the arms 12 being spaced apart from each other. Each of the arms 12 has a first surface 16 and the first surface 16 corresponding to each of the arms 12 has a well 18 extending inwardly therein. The first surface 16 corresponding to each of the arms 12 faces each other. Each of the arms 12 may be a toilet paper holder of any conventional design and the vertical support surface 14 may be a wall.

A holder 20 is hingedly coupled between the pair of arms 12. The holder 20 is selectively positioned in an open position to have a roll of toilet paper 22 positioned thereon. The holder 20 is selectively positioned in a closed position to retain the roll of toilet paper 22 between the arms 12. The roll of toilet paper 22 may be toilet paper of any conventional design.

The holder 20 comprises a first coupler 24 that has a first end 26, a second end 28 and an outer surface 30 extending therebetween. The first end 26 has a diameter that is less than a diameter of the second end 28 and the second end 28 has a notch 32 extending toward the first end 26. The notch 32 is vertically oriented on the first coupler 24. The outer surface 30 has a cut out portion 34 that is aligned with the second end 28 and the cut out portion 34 intersects the notch 32. The first end 26 is slidably inserted into the well 18 in an associated one of the arms 12.

The holder 20 further comprises a second coupler 36 that has a primary end 38 and a secondary end 40. The primary end 38 has a diameter that is less than a diameter of the secondary end 40. The primary end 38 is slidably inserted into the well 18 corresponding to an associated one of the arms 12.

A shaft 42 is provided that has a leading end 44 and a following end 46. The following end 46 has a tab 48 extending outwardly therefrom and the tab 48 is positioned in the notch 32 in the first coupler 24. The shaft 42 extends horizontally between the arms 12 when the holder 20 is positioned in the closed position having the tab 48 abuts the first coupler 24 thereby retaining the shaft 42 in the horizontal orientation. The shaft 42 extends upwardly at an angle from the first coupler 24 having the leading end 44 extending into the cut out portion 34 such that the leading end 44 is inhibited from engaging the first coupler 24.

A pin 50 is provided that extends through the first coupler 24 and the tab 48 such that the shaft 42 is hingedly retained on the first coupler 24. A strap 52 is provided that has a first end 54 and a second end 56. The first end 54 of the strap 52 is coupled to the first coupler 24 and the second end 56 of the strap 52 is coupled to the second coupler 36. The strap 52 is comprised of a resiliently bendable material such that the strap 52 biases the second coupler 36 away from the first coupler 24. In this way the strap 52 retains each of the first 24 and second 36 couplers in the well 18 in the associated arm 12.

In use, each of the first 24 and second 36 couplers is inserted into the well 18 in the associated arm. The shaft 42 is manipulated into the open position and the roll of toilet paper 22 is positioned around the shaft 42. The shaft 42 is manipulated into the closed position to facilitate the toilet paper 22 to be selectively drawn off of the shaft 42. The holder 20 replaces a traditional spring loaded toilet paper holder.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet paper holding system comprising:

a pair of arms, each of said arms being configured to be coupled to a vertical support surface having said arms being spaced apart from each other; and a holder being hingedly coupled between said pair of arms, said holder being selectively positioned in an open position wherein said holder is configured to have a roll of toilet paper positioned thereon, said holder being selectively positioned in a closed position wherein said holder is configured to retain the roll of toilet paper between said arms, said holder comprising a first coupler having a first end, a second end and an outer surface extending therebetween, said first end having a diameter being less than a diameter of said second end, said second end having a notch extending toward said first end.

2. The system according to claim 1, wherein each of said arms has a first surface, said first surface corresponding to each of said arms having a well extending inwardly therein, said first surface corresponding to each of said arms facing each other.

3. The system according to claim 1, wherein said outer surface has a cut out portion being aligned with said second end, said cut out portion intersecting said notch, said first end being slidably inserted into said well corresponding to an associated one of said arms.

4. The system according to claim 3, further comprising a shaft having a leading end and a following end, said following end having a tab extending outwardly therefrom, said tab being positioned in said notch in said first coupler, said shaft extending horizontally between said arms when said holder is positioned in said closed position, said shaft extending upwardly at an angle from said first coupler having said leading end extending into said cut out such that said leading end is inhibited from engaging said first coupler.

5. The system according to claim 4, further comprising a pin extending through said first coupler and said tab such that said shaft is hingedly retained on said first coupler.

6. The system according to claim 1, further comprising a second coupler having a primary end and a secondary end, said primary end having a diameter being less than a diameter of said secondary end, said primary end being slidably inserted into said well corresponding to an associated one of said arms.

7. A toilet paper holding system comprising:

a pair of arms, each of said arms being configured to be coupled to a vertical support surface having said arms being spaced apart from each other; and a holder being hingedly coupled between said pair of arms, said holder being selectively positioned in an open position wherein said holder is configured to have a roll of toilet paper positioned thereon, said holder being selectively positioned in a closed position wherein said holder is configured to retain the roll of toilet paper between said arms, said holder comprising a first coupler, a second coupler, and a strap having a first end and a second end, said first end of said strap being coupled to said first coupler, said second end of said strap being coupled to said second coupler, said strap biasing said second coupler away from said first coupler such that said strap retains each of said first coupler and said second coupler in said well in an associated one of arms.

8. A toilet paper holding system comprising:

a pair of arms, each of said arms being configured to be coupled to a vertical support surface having said arms being spaced apart from each other, each of said arms having a first surface, said first surface corresponding to each of said arms having a well extending inwardly therein, said first surface corresponding to each of said arms facing each other; and a holder being hingedly coupled between said pair of arms, said holder being selectively positioned in an open position wherein said holder is configured to have a roll of toilet paper positioned thereon, said holder being selectively positioned in a closed position wherein said holder is configured to retain the roll of toilet paper between said arms, said holder comprising:

a first coupler having a first end, a second end and an outer surface extending therebetween, said first end having a diameter being less than a diameter of said second end, said second end having a notch extending toward said first end, said outer surface having a cut out portion being aligned with said second end, said cut out portion intersecting said notch, said first end being slidably inserted into said well corresponding to an associated one of said arms, a second coupler having a primary end and a secondary end, said primary end having a diameter being less than a diameter of said secondary end, said primary end being slidably inserted into said well corresponding to an associated one of said arms, a shaft having a leading end and a following end, said following end having a tab extending outwardly therefrom, said tab being positioned in said notch in said first coupler, said shaft extending horizontally between said arms when said holder is positioned in said closed position having said tab abutting said first coupler thereby retaining said shaft in the horizontal orientation, said shaft extending upwardly at an angle from said first coupler having said leading end extending into said cut out such that said leading end is inhibited from engaging said first coupler, a pin extending through said first coupler and said tab such that said shaft is hingedly retained on said first coupler, and a strap having a first end and a second end, said first end of said strap being coupled to said first coupler, said second end of said strap being coupled to said second coupler, said strap biasing said second coupler away from said first coupler such that said strap retains each of said first coupler and said second coupler in said well in an associated one of arms.

* * * * *